US006644514B2

(12) United States Patent
Wickins

(10) Patent No.: US 6,644,514 B2
(45) Date of Patent: Nov. 11, 2003

(54) LIQUID DISCHARGE CONTROL APPARATUS

(76) Inventor: Jeremy Wickins, Blackstone Cottage, 41 Leylands Road, Burgess Hill, Sussex RH15 8AF (GB)

( * ) Notice: Subject to any disclaimer, the term of this patent is extended or adjusted under 35 U.S.C. 154(b) by 0 days.

(21) Appl. No.: 09/801,957

(22) Filed: Mar. 8, 2001

(65) Prior Publication Data

US 2002/0003149 A1 Jan. 10, 2002

(30) Foreign Application Priority Data

Mar. 8, 2000 (GB) ..... 0005578

(51) Int. Cl.[7] ..... B67D 5/06
(52) U.S. Cl. ..... 222/185.1
(58) Field of Search ..... 222/185.1

(56) References Cited

U.S. PATENT DOCUMENTS 1,272,688 A * 7/1918 Lyons ..... 137/578
3,374,726 A * 3/1968 Takayanagi ..... 137/578
4,881,661 A * 11/1989 Jones ..... 222/185.1
5,290,434 A * 5/1994 Richard ..... 137/578

FOREIGN PATENT DOCUMENTS

| | | |
|---|---|---|
| DE | 4007599 | 9/1991 |
| DE | 19742594 | 4/1999 |
| EP | 0422499 | 4/1991 |

* cited by examiner

*Primary Examiner*—Philippe Derakshani
(74) *Attorney, Agent, or Firm*—Cook, Alex, McFarron, Manzo, Cummings & Mehler, Ltd.

(57) ABSTRACT

Liquid discharge control apparatus comprising a liquid conduit for discharging liquid from a container, at least one mouth through which liquid to be discharged can pass into the conduit, and level follower means to ensure that the mouth is moved to follow the level of the liquid in the container as that level changes. Relative mouth-level adjustment means are provided to adjust the level of the mouth between a position in which it is below the surface of liquid in a container to a position in which it is above that surface. The relative mouth-level adjustment means comprise at least one float having a selectively variable displacement.

7 Claims, 3 Drawing Sheets

LIQUID DISCHARGE CONTROL APPARATUS

The present invention relates to discharge means comprising a liquid conduit for discharging liquid from a container, at least one mouth through which liquid to be discharged can pass into the conduit, level follower means to ensure that the mouth is moved to follow the level of the liquid in the container as that level changes, and relative mouth-level adjustment means to adjust the level of the mouth between a position in which it is below the surface of liquid in a container to a position in which it is above that surface. If the liquid is effluent, this reduces the likelihood of ingress of untreated effluent filling the discharge pipe whilst the treatment of the effluent is in progress. When the mouth is below the level of effluent, it is just below the surface, to be clear of floating debris actually on the surface, to reduce the likelihood of such debris contaminating the clear treated effluent just below the surface. Such previously proposed discharge means have relative mouth-level adjustment means in the form of a cable and winch arrangement to raise and lower the mouth, but such means are cumbersome and difficult to install and maintain.

The present invention seeks to provide a remedy.

Accordingly, the present invention is directed to discharge means having the construction set out in the opening paragraph of the present specification, in which the relative mouth-level adjustment means comprise at least one float having a selectively variable displacement.

Such discharge means are especially effective within a container which constitutes an effluent treatment tank, and in which the liquid to be discharged by the discharge means is treated effluent. The or each float may be provided with means to pump air or other gaseous material into and out of the float. For example, the float may comprise a hollow body with an opening, such as a hollow cylinder closed at one end and open at the other. Such a float may be oriented such that its opening is directed downwardly, and the feed means may be arranged to feed air or other gaseous material into the interior of the float.

The conduit may comprise an arm which extends within the container interior from a position in the wall of the container which is below an intended level of the liquid, so that discharge can be effected by the Force of gravity. The arm may be pivoted to enable it to remain adjacent to the surface of liquid within a container whilst the level of that surface changes.

An example of discharge means made in accordance with the present invention is shown in the accompanying drawings, in which.

Figure 1:
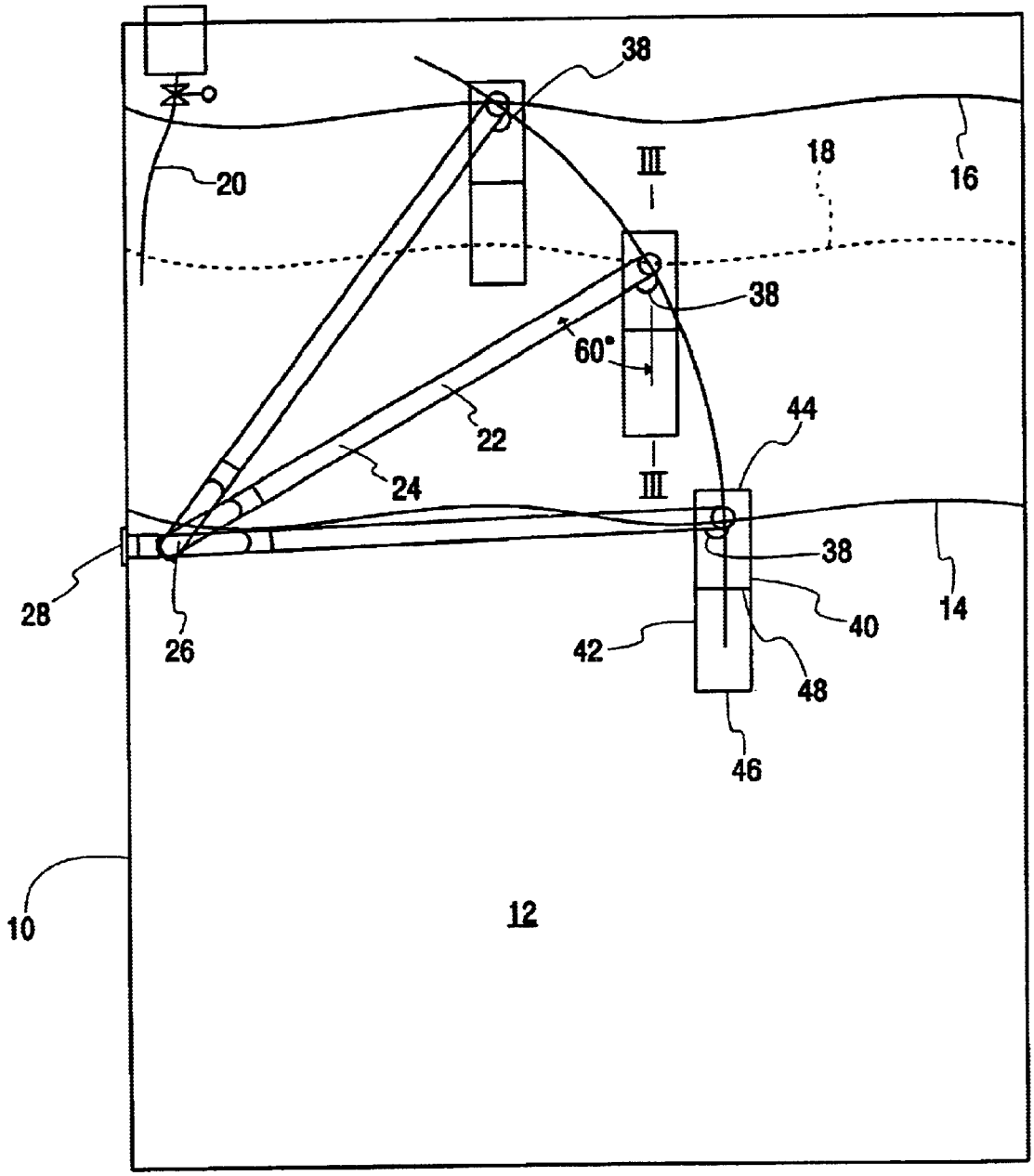
FIG. 1 shows a diametric cross-sectional view of an effluent treatment tank provided with such discharge means.

As shown in the Figures, a tank 10 contains treated effluent 12. The level of the treated effluent 12 may vary anywhere between a minimum level 14 and a maximum level 16, for example it may be at level 18. The actual level is dependent upon the amount of effluent which has flowed into the container 10 via the inlet 20, and the amount of effluent which has flowed out of the discharge means 22 at any given time.

Figure 2:
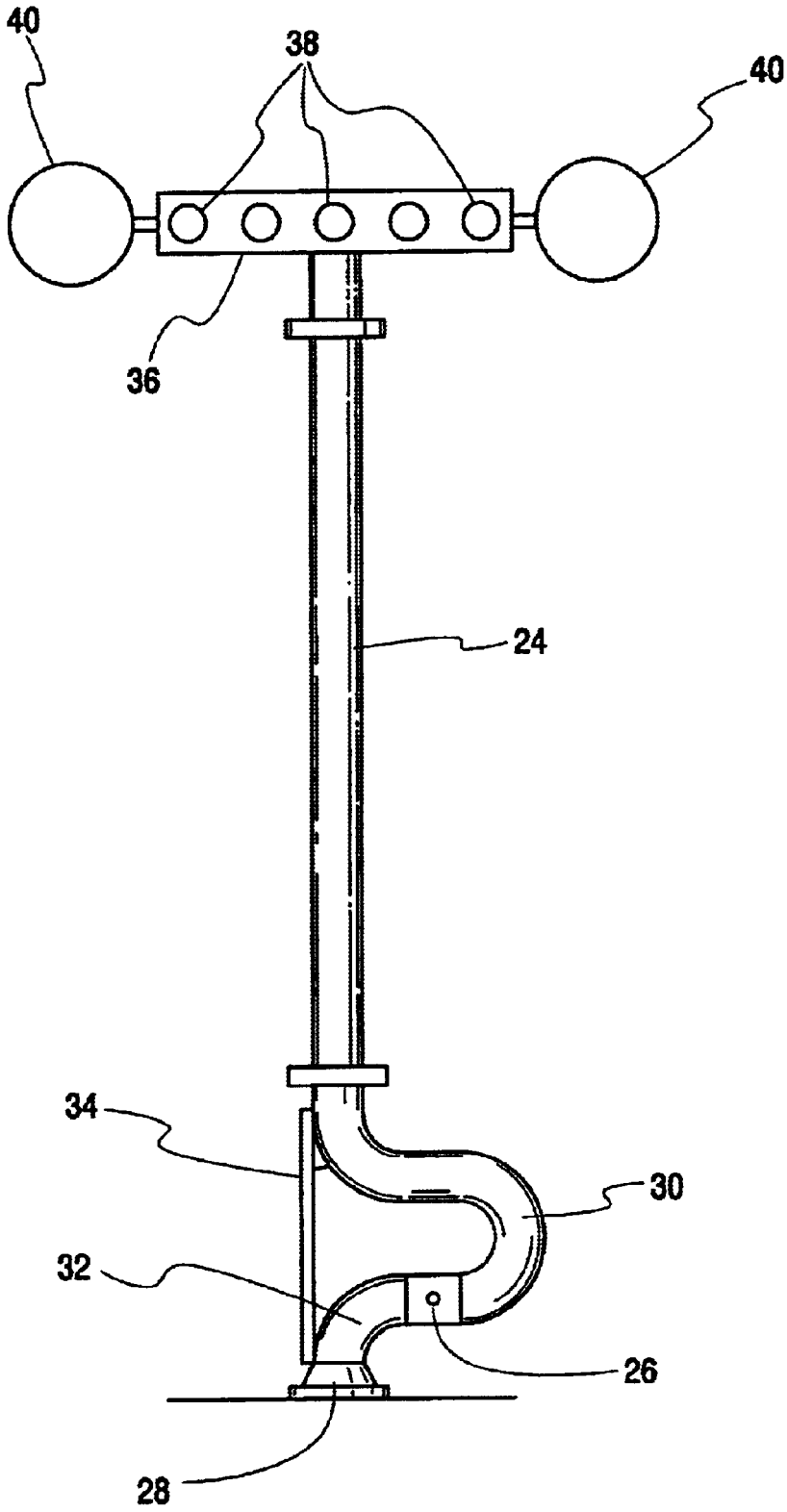
FIG. 2 shows an underneath view of the discharge means shown in FIG. 1.
Figure 3:
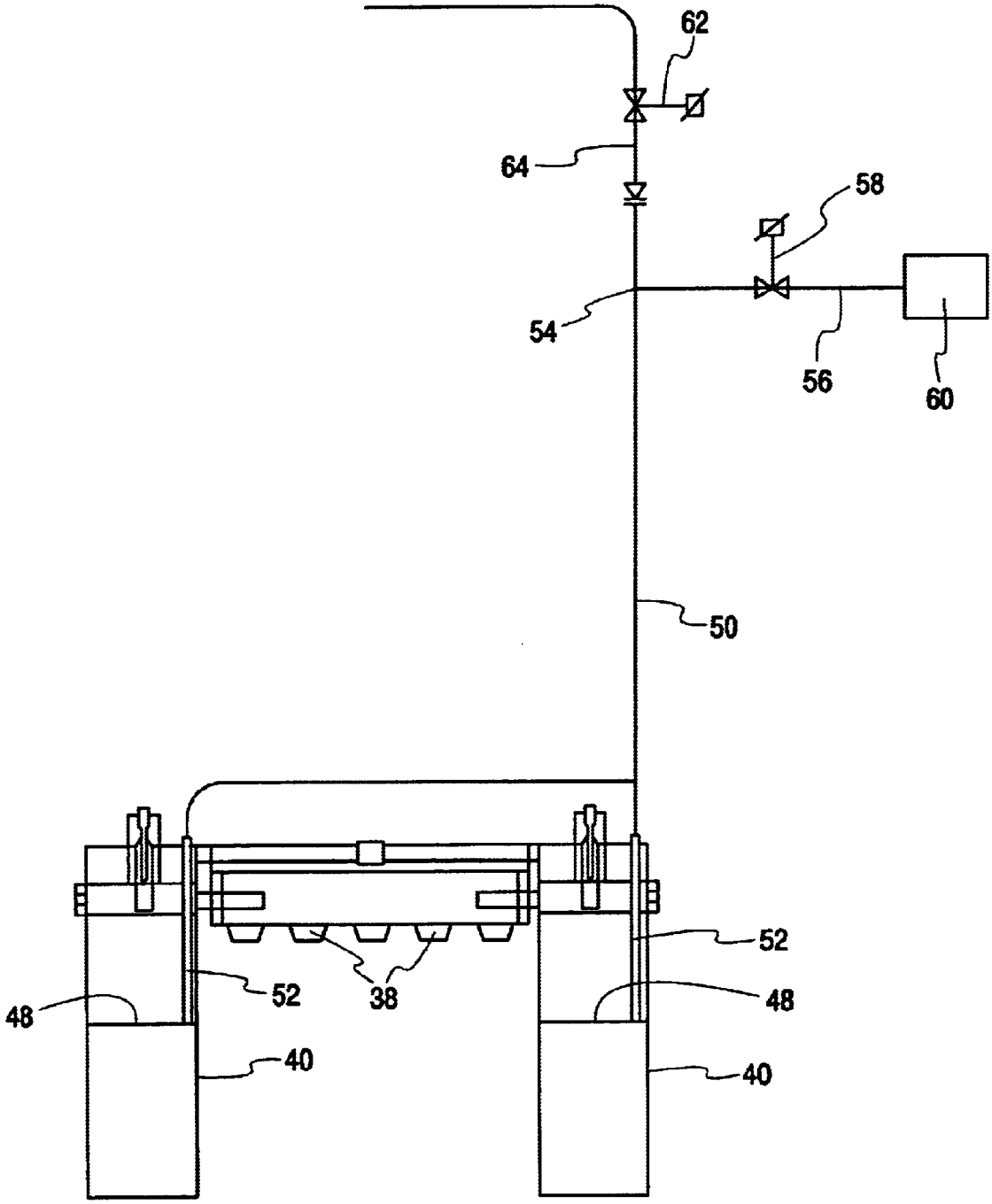
FIG. 3 shows a diametric cross-sectional view of discharge means shown in FIG. 1, taken along the line III shown in that Figure, together with pneumatic circuitry associated with the discharge means.

The discharge means or liquid discharge control apparatus comprises a hollow arm 24 constituting a conduit and comprises level follower means which includes a pivot 26 so that the arm is pivoted at the pivot 26 to a discharge outlet 28 which passes through the cylindrical outer wall of the container 10. As can be seen clearly in FIG. 2, the arm 24 is provided with a U-bend 30 to facilitate its connection to the pivot 26. The outlet 28 is connected to the pivot 26 via an angled section 32. A strengthening strut 34 extends between the outlet 28 and the arm 24.

At the other end of the arm 24 there is provided a gallery 36 having a plurality of downwardly directed mouths 38. The level follower means ensures that the plurality of mouths 38 are moved to follow the level of the liquid in the container as that level changes.

Two floats 40 are provided at respective opposite ends of the gallery 36. These floats 40 each comprise a hollow cylinder 42 having a closed upper end 44 and open lower end 46. Both floats are pivotally attached to the gallery 36 at the intended upper, closed end of the cylinder 42. The weight of the cylinder therefore ensures that it is always suspended in a downward direction from the gallery 36.

The upper half of each cylinder 40 is sealed by a diaphragm 48. This constitutes therefore a portion of the float 40 which gives rise to a fixed displacement that does not vary, and is sufficient to keep the mouth 38 just below the surface level of the effluent. However, an air feed pipe 50 is connected to passageways 52 which pass through the upper half of each cylinder 40 and through the diaphragm 48. Therefore, air can be pumped into the lower half of each cylinder 40 or removed therefrom, to vary the total displacement effected by each float 40.

Air can be fed to the feed pipe 50, via a T-piece 54 and a further passageway 56 having a non-return valve 58, from a low pressure air source 60. Air can be removed from each float 40 via a further open-and-close valve 62 in a further passageway 64 having one end in communication with the feed pipe 50 and the other end open to atmosphere.

When the discharge means are in operation with effluent filling the tank 10, the displacement of the floats 40 is such as to ensure that the mouths 38 are a little below the surface level of the effluent in the tank 10. This relative position of the mouths 38 in relation to the liquid surface level is maintained by virtue of the fact that the arm 24 can pivot about pivot 26. Effluent passes through the mouths 38 and out of the tank 10 via the conduit 24 under the force of gravity.

In the event that draining of water from the tank 10 via the conduit 24 and outlet 28 is no longer desired, air from the low pressure air source 60 is fed into the lower half of the floats 40 to increase the displacement of water by the floats and thus to raise the level of the mouths 38 to a level which is above the surface of the liquid in the tank 10. This prevents further drainage, discharge or decanting of effluent from the tank.

In the event that the low pressure air source 60 fails, commencement of an aeration process in the tank (by means not shown) to treat the effluent would refloat the discharge means, by virtue of air accumulating in the cylinders 42.

An advantage of the illustrated construction is that no valve is needed in the discharge means which might get fouled by effluent and no lift tackle is needed for the relative mouth-level adjustment.

I claim:

1. Liquid discharge control apparatus comprising a liquid conduit for discharging liquid from a container, at least one mouth through which liquid to be discharged can pass into the conduit, level follower means to ensure that the mouth is moved to follow the level of the liquid in the container as that level changes, and relative mouth-level adjustment means to adjust the level of the mouth between a position in which it is below the surface of liquid in the container to a position in which it is above that surface, wherein the relative mouth-level adjustment means comprise at least one float having a selectively variable displacement, wherein said at least one float is provided with means to pump gaseous material into and out of the float, said means being able to pump gaseous material into the float and being able to effect removal of gaseous material from the float.

2. Discharge means according to claim 1, in which the float comprises a hollow body with an opening.

3. Discharge means according to claim 2, in which the float comprises a hollow cylinder closed at one end and open at the other.

4. Discharge means according to claim 2, in which the float is oriented such that its opening is directed downwardly.

5. Discharge means according to claim 4, in which said means includes feed means being arranged to feed gaseous material into the interior of the float.

6. Discharge means according to claim 1, in which the conduit comprises an arm which extends within the container interior from a position in the wall of the container which is below an intended level of the liquid, so that discharge can be effected by the force of gravity.

7. Discharge means according to claim 1, in which the arm is pivoted to enable it to remain adjacent to the surface of liquid within the container whilst the level of that surface changes.

* * * * *